US008997888B2

(12) United States Patent
Roodenburg et al.

(10) Patent No.: US 8,997,888 B2
(45) Date of Patent: Apr. 7, 2015

(54) HOISTING DEVICE

(75) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 440 days.

(21) Appl. No.: 13/496,835

(22) PCT Filed: Sep. 16, 2010

(86) PCT No.: PCT/NL2010/050596

§ 371 (c)(1),
(2), (4) Date: May 14, 2012

(87) PCT Pub. No.: WO2011/034422

PCT Pub. Date: Mar. 24, 2011

(65) Prior Publication Data

US 2012/0217063 A1 Aug. 30, 2012

Related U.S. Application Data

(60) Provisional application No. 61/243,857, filed on Sep. 18, 2009.

(51) Int. Cl.

| | |
|---|---|
| ***B63B 35/44*** | (2006.01) |
| ***E21B 7/12*** | (2006.01) |
| ***B63B 35/03*** | (2006.01) |
| ***B66C 13/02*** | (2006.01) |
| *B63B 27/10* | (2006.01) |

(52) U.S. Cl.
CPC *B66C 13/02* (2013.01); *B63B 27/10* (2013.01)

(58) Field of Classification Search
USPC ..... 175/203, 176, 27, 24; 254/266, 285, 254/290, 377, 387; 414/139.6, 803
See application file for complete search history.

(56) References Cited

U.S. PATENT DOCUMENTS

| | | | | | |
|---|---|---|---|---|---|
| 840,684 | A | * | 1/1907 | Bode et al. | 212/308 |
| 2,572,165 | A | * | 10/1951 | Locki | 212/272 |
| 3,721,293 | A | * | 3/1973 | Ahlstone et al. | 166/355 |
| 5,028,194 | A | * | 7/1991 | Robinson | 414/139.6 |
| 6,926,103 | B1 | | 8/2005 | Roodenburg et al. | |

(Continued)

FOREIGN PATENT DOCUMENTS

| | | | |
|---|---|---|---|
| EP | 1433922 | A2 | 6/2004 |
| FR | 2764591 | A1 | 12/1998 |

(Continued)

*Primary Examiner* — James G Sayre
(74) *Attorney, Agent, or Firm* — Birch, Stewart, Kolasch & Birch, LLP

(57) ABSTRACT

A multi purpose hoisting device for use on a floating vessel having a deck, including: a load bearing structure to be mounted on the vessel; a main hoisting mechanism for raising/lowering an object above the deck and including: at least one main hoisting winch; an upper cable pulley block supported by the load bearing structure; a travelling cable pulley block; a main hoisting cable associated with the at least one main hoisting winch and passed over pulleys of the upper cable pulley block and of the travelling pulley block in a multiple fall configuration, such that the travelling cable pulley block is moveable relative to the load bearing structure by using the at least one main hoisting winch; a main hoist heave compensation mechanism associated with the main hoisting cable for damping the effect of sea-state induced motion of the vessel onto an object supported by the main hoisting cable.

29 Claims, 10 Drawing Sheets

(56) References Cited

U.S. PATENT DOCUMENTS

| | | | | |
|---|---|---|---|---|
| 6,926,260 | B1 * | 8/2005 | De Groot et al. | 254/277 |
| 2012/0025156 | A1 * | 2/2012 | Roodenburg et al. | 254/337 |
| 2012/0156003 | A1 * | 6/2012 | Battersby et al. | 414/803 |

FOREIGN PATENT DOCUMENTS

| | | | |
|---|---|---|---|
| WO | WO 02/18742 | A1 | 3/2002 |
| WO | WO 03/062042 | A1 | 7/2003 |

* cited by examiner

HOISTING DEVICE

Cross Reference to Related Applications

This application is the National Phase of PCT/NL2010/050596 filed on Sep. 16, 2010, which claims priority under 35 U.S.C. 119(e) to U.S. Provisional Application No. 61/243,857 filed on Sep. 18, 2009, all of which are hereby expressly incorporated by reference into the present application.

FIELD AND BACKGROUND OF THE INVENTION

The present invention relates to a multi purpose hoisting device, according to the preamble of claim 1. The present invention also relates to a method for lowering an object to a deepwater installation site.

A second aspect of the invention relates to a hoisting device comprising a heave compensation mechanism, according to the preamble of claim 19.

Multi purpose hoisting devices are known from the art, and are typically used on a drilling vessels, pipe laying vessels and production platforms.

For example, WO 02/18742 discloses a drilling mast, also referred to as multi purpose tower. Such a drilling mast is typically mounted on a drilling vessel, for drilling in the seabed, for example for oil or gas. This particular drilling mast is at its top side provided with first and second hoisting device in a first and second firing line, for manipulating objects, such as a drill string, in the longitudinal direction of the mast.

Drilling from a vessel is carried out with a drilling tool fixed on the end of a drill string. The drill string is supported by one of the hoisting mechanisms, more in particular by a trolley which is movably connected to the drilling mast and supported by a hoisting cable.

Each of the hoisting mechanisms is provided with a heave compensation system. Such heave compensation systems are generally known. A heave compensation system is used to compensate for the movements that the ship makes relative to the seabed, as a result of wind, swell and the like. With the heave compensation system, the hoisting mechanism can keep the position of the trolley, and thus the end of the drill string, substantially constant relative to the seabed during the assembly of the drilling mast, or during the drilling.

Besides manipulating objects such as drill strings, with off shore exploration there is also the need for lifting and lowering objects, such as blow out preventers (BOP), BOP stack modules, X-mas trees and subsea manifolds, to and from deepwater installation sites.

For this purpose, the vessel can be provided with a deepwater hoisting crane comprising a deepwater hoisting mechanism. However, an extra crane requires extra deck space, which is limited on a floating vessel. Furthermore, the crane adds extra weight to the vessel.

OBJECT OF THE INVENTION

It is an object of a first aspect of the invention to provide a multi purpose hoisting device in which the above mentioned drawbacks are eliminated altogether or occur in a greatly reduced extent. In particular it is an object of the first aspect of the invention to provide an improved, preferably a compact and low cost, multi purpose hoisting device.

A further object according to the first aspect of the invention is to provide an improved, preferably low cost, method for lowering an object to an deepwater installation site.

It is an object of a second aspect of the invention to provide an improved heave compensation mechanism, preferably a low cost and/or compact heave compensation mechanism.

SUMMARY

To achieve these objects, according to a first aspect of the invention, a multi purpose hoisting device according to claim 1 and a method according to claim 16 are provided.

A multi purpose hoisting device according to claim 1 is designed for use on a floating vessel having a deck. For example, a drilling vessel, a pipe laying vessel or a production platform.

The multi purpose hoisting device comprises a load bearing structure, a main hoisting mechanism comprising a main hoisting cable, a heave compensation mechanism, and a deepwater hoisting mechanism comprising a deepwater hoisting cable.

By providing the multi purpose hoisting device with a deepwater hoisting device, no separate crane is needed for lowering objects into deepwater. This saves space, and weight.

Furthermore, the heave compensation mechanism is provided, associated with the main hoisting cable, for damping the effect of the movement of the vessel onto an object supported by the main hoisting cable. Thus, the main hoisting mechanism can keep the position of an object and/or a trolley supported by the main hoist cable substantially constant relative to the seabed.

The multi purpose hoisting device furthermore comprises a releasable attachment mechanism for interconnecting the main hoisting cable and the deepwater hoisting cable. The releasable attachment mechanism is designed for interconnecting the main hoisting cable and the deepwater hoisting cable such that the heave compensation mechanism associated with the main hoisting cable is operable in combination with the deepwater hoisting cable.

This is particularly useful when landing or lifting an object on or from a deepwater installation site using the deepwater hoisting cable. When no heave compensation is provided, the vertical movement of the ship may cause the object to slam into the deepwater installation site damaging the object and/or the installation site.

With a multi purpose hoisting device according to the invention a single heave compensation mechanism is provided which is part of the main hoisting mechanism and which can be used when lifting or lowering an object with the main hoist mechanism as well as when lifting or lowering an object with the deepwater hoisting mechanism, more in particular with the deepwater hoisting cable of the deepwater hoisting mechanism.

Since no separate heave compensation is necessary for the deepwater hoisting mechanism, the hoisting device can be relatively compact of design. Furthermore, using only one instead of two heave compensation mechanisms saves costs and space.

It is observed that main hoisting mechanisms typically comprises a hoisting cable configured in a multiple fall arrangement between a cable pulley block fixed to a load bearing structure and a travelling cable pulley block provided with a hook for connecting to an object to be supported. The main hoist cable is looped multiple times between the upper cable pulley block and the moveable cable pulley block such that the load of the object is divided over multiple wires.

Deepwater hoisting mechanisms typically comprises a single cable for supporting an object. Using multiple or looped cables is avoided with deepwater hoisting mechanisms. When operating at great depth, the danger of long wires getting tangled up and/or damaging each other is too big. To enable the deepwater hoisting mechanism to support heavy objects, the deepwater hoisting cable is relatively thick, and thus stiff. Therefore, running the deepwater cable over pulleys, causing the cable to bend, leads to excessive wear of the cable.

The deepwater hoisting cable with a hoisting device according to the first aspect of the invention runs along a path from the deepwater hoisting winch to a top pulley supported by the load bearing structure. This path of the deepwater hoisting cable is distinct from the main hoist heave compensation mechanism. Thus, the deep water hoisting cable does not come into contact with pulleys of the heave compensation system, which reduces wear of the deep water hoisting cable.

In a preferred embodiment the main hoisting mechanism comprises a trolley for supporting the releasable attachment mechanism, which trolley is connected to the travelling cable pulley block of the main hoisting mechanism, and is moveably attached to the load bearing structure, such that the trolley is vertically movable relative to the load bearing structure using the main hoisting mechanism.

With a releasable attachment device supported by a free hanging travelling pulley block there is the risk of the attachment device swinging with respect to the load bearing structure due to the heave of the vessel. The trolley limits the movement of the releasable attachment mechanism with respect to the load bearing structure to movement in the vertical direction. It thus prevents swinging of the attachment device relative to the load bearing structure and facilitates interconnecting the main hoisting cable and the deepwater hoisting cable.

In a further preferred embodiment the trolley is provided with a guiding device, for example a circular guide opening, for guiding the deepwater hoisting cable when the latter is supporting an object, which guiding device positions the deepwater hoisting cable with respect to the releasable attachment mechanism. Thus, the movement of the deepwater hoisting cable with respect to the releasable attachment mechanism, for example due to the movement of the vessel, is limited. This facilitates interconnecting the main hoisting cable and the deepwater hoisting cable.

In a preferred embodiment, the releasable attachment mechanism for interconnecting the main hoisting cable and the deepwater hoisting cable, comprises a friction device to engage the deepwater hoisting cable. Using friction to engage the deepwater hoisting cable allows for a simple and direct way of engaging the hoisting cable and for engaging the cable at a random position. In an alternative embodiment, the deepwater hoisting cable can be provided with connection eyes positioned at intervals along the length of the cable.

Preferably the friction device comprises a friction clamping mechanism, for example a hydraulic clamp. Alternatively, the friction mechanism comprises a preferably conically shaped guiding opening in the trolley or travelling pulley block and one or more wedges for clamping the cable in the guide opening. The combination of a guiding opening and wedges provides a relatively simple, and therefore reliable and low cost solution for interconnecting the main hoisting cable and the deepwater hoisting cable.

In a further preferred embodiment, the deepwater cable is moveably supported by the load bearing structure such that the section of the deepwater hoisting cable hanging down form the wop pulley, also called the free hanging section of the deepwater hoisting cable, can be moved relative to the main hoisting cable in a horizontal direction between a first position and a second position. In the first position the free hanging section of the deepwater hoisting cable is positioned at a distance from the main hoisting cable. In the second position the free hanging end of the deepwater hoisting cable is positioned close to the main hoisting cable such that they can be interconnected.

When the deepwater cable is in the first position the main hoisting device is used for lifting and lowering an object without the object and/or the main hoisting cable getting entangled with the deepwater cable. When the deep water cable is in the second position the main hoisting device is used to support the deepwater cable. In a preferred embodiment the deep water hoisting device is operable when positioned in the first position also.

A hoisting device according the first aspect of the invention is a multi purpose hoisting device comprising a main hoisting mechanism, or possibly more than one, which hoisting mechanism is preferably adapted for lifting objects above a deck of the vessel on which the hoisting device is mounted. Furthermore, a deepwater hoisting mechanism is provided, which is adapted to lower an object into deepwater, preferably to a depth of more than 200 m, preferably to a depth of 1 km, more preferably to a depth of 2.5 km or more.

Furthermore, the main hoisting mechanism is preferably is adapted to support an object weighing 400 metric tons or more, and the deepwater hoisting mechanism is preferably adapted to support an object weighing up to 300 metric tons. The deep water hoisting mechanism according to the invention is suitable for all sorts of activities in deepwater, such as: template installation, wellhead installation, jumper installation, etc.

The first aspect of the invention also relates to a method according to claim 16, for lowering an object from a floating vessel to a deepwater installation site, wherein use is made of a multi purpose hoisting device.

This multi purpose hoisting device comprises a main hoisting mechanism for raising and lowering an object near the water surface, preferably for raising and lowering the object above a deck of the vessel.

The main hoisting mechanism further comprises a heave compensation mechanism associated with a main hoisting cable for damping the effect of the movement of the vessel, as a result of heave and beating of waves, onto an object supported by the main hoisting cable.

The multi purpose hoisting device also comprises a deepwater hoisting mechanism for raising and lowering an object to a deepwater installation site, preferably to an installation site at a depth of 1 km or more.

The deepwater hoisting mechanism comprises a deepwater hoisting winch and an associated deepwater hoisting cable. The deepwater hoisting cable runs along a path from the deepwater hoisting winch to a top pulley supported by a load bearing structure of the hoisting device. The path of the deepwater hoisting cable is distinct from the main hoist heave compensation mechanism.

The multi purpose hoisting device further comprises a releasable attachment mechanism for interconnecting the main hoisting cable and the deepwater hoisting cable such that the heave compensation mechanism associated with the main hoisting cable is operable in combination with the deepwater hoisting cable, In this method the hoisting device is used for lowering an object from a position near the water surface towards an intermediate underwater position near the under water installation site using the deepwater hoisting mechanism.

Then the deepwater hoisting cable and the main hoisting cable are interconnected and the load of the object is transferred from the deepwater hoisting mechanism to the main hoisting mechanism.

Subsequently the object is lowered from the intermediate underwater position towards the under water installation site and landing the object on the deepwater installation site using the main hoisting mechanism and a section of the deepwater hoisting cable. The heave compensating mechanism of the main hoisting mechanism compensates for movements of the vessel relative to the deepwater installation site while lowering and landing the object.

Thus, the heave compensation mechanism associated with the main hoisting device can also be used in combination with a load supported by the deepwater hoisting cable. Therefore, only one heave compensation mechanism is needed, which saves space and weight.

Furthermore, the path of the deepwater hoisting cable is distinct from the main hoist heave compensation mechanism. Thus, an object supported by the deepwater cable can be heave compensated, while the deep water hoisting cable is not guided over pulleys of the heave compensation device. This reduces wear in the deepwater hoisting cable.

In a preferred method according to the invention the object is to be connected to the deepwater installation site via a connection cable. Preferably the connection is made when the object is positioned in the intermediate underwater position. This position is relatively close to the deepwater installation site, preferably within a distance of 50 meters to the installation site, in comparison to the depth at which the installation site is located, which is typically at a depth of 1000 meters or more.

In this method the object, supported by the hoisting device, is pulled towards the deepwater installation site, and subsequently landed on the deepwater installation site, using the connection cable and an associated winch. The tension in the connection cable in addition to the heave compensation further limits the vertical movement of the object caused by movement of the vessel on the waves. Pulling the object towards the installation site in combination with using a heave compensation mechanism, reduces the movement of the supported object caused by the vertical movement of the ship. Thus the object can be landed on, or lifted from, a deepwater installation site in a more controlled manner.

According to a second aspect of the invention, a hoisting device according to claim 19 is provided. The hoisting device comprises a hoisting mechanism with a hoisting cable, at least one associated hoisting winch and a heave compensation mechanism for providing active and passive heave compensation.

The heave compensation mechanism comprises an electronic system for detecting heave and for driving the at least one winch for providing active heave compensation. The heave compensation mechanism further comprises an underload protection cylinder and/or an overload protection cylinder. According to the second aspect of the invention, the underload protection cylinder and/or the overload protection cylinder is/are adapted to be switched between a protection mode in which they protect the hoisting mechanism against underload or overload respectively, and a heave compensation mode, in which the cylinders are positioned in an intermediate position to provide passive heave compensation.

When the heave compensation mechanism provides active heave compensation, the electronic system drives the at least one winch to provide heave compensation. The cylinders are set in the protection mode.

When the heave compensation mechanism provides passive heave compensation. The passive heave compensation is achieved by the cylinders, which are set in the heave compensation mode.

Thus the heave compensation mechanism needs fewer cylinders compared to known heave compensation mechanisms which comprise dedicated cylinders capable of only providing protection or only providing heave compensation. The heave compensation mechanism according to the second aspect of the invention is therefore compact compared to known heave compensation systems.

Further objects, embodiments and elaborations of the both aspects of the invention will be apparent from the appended claims and from the following description, in which the invention is further illustrated and elucidated on the basis of a number of exemplary embodiments, with reference to the drawings.

The man skilled in the art will understand that the first and second aspect of the invention can be used in a single hoisting device.

DETAILED DESCRIPTION

Figure 1:
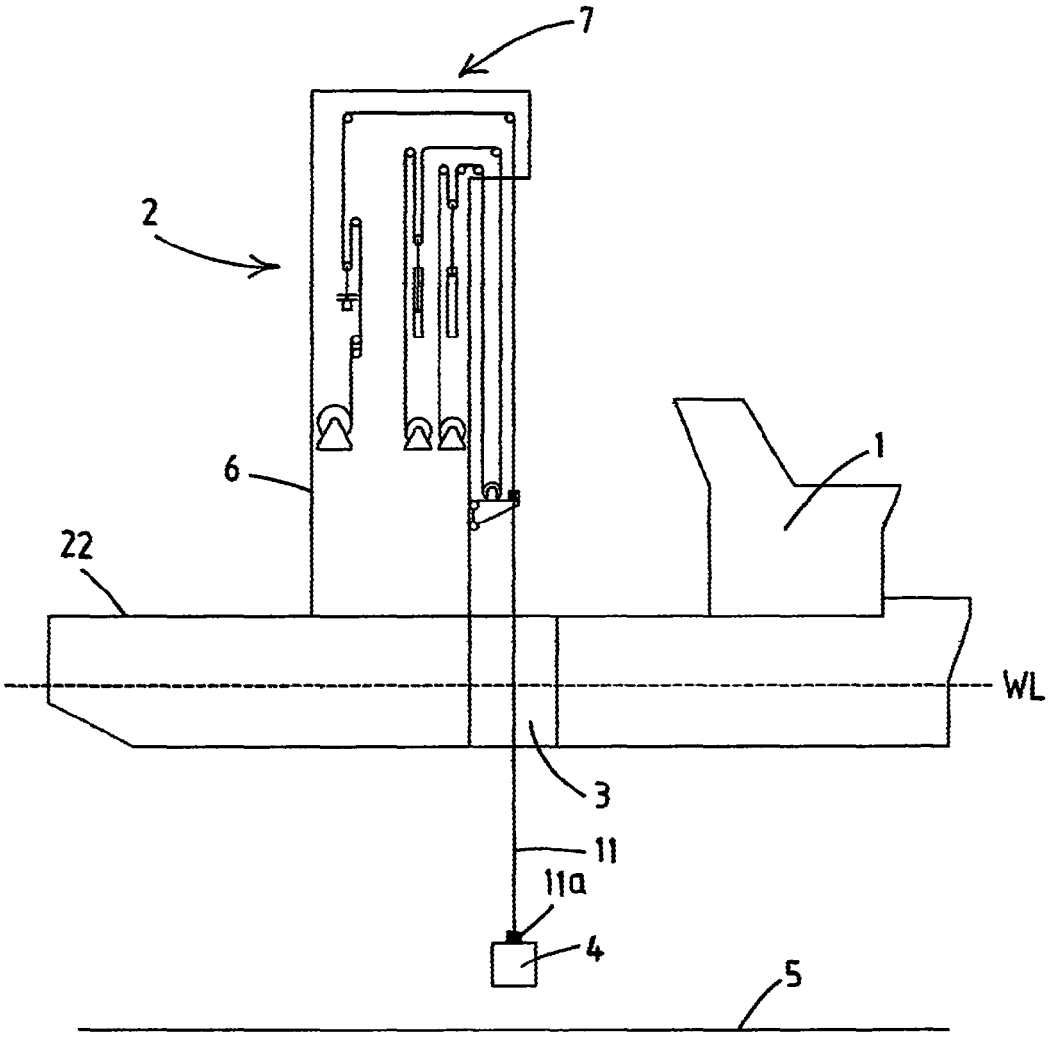
FIG. 1 shows a schematic side view in section of a vessel provided with a multi purpose hoisting device according to the first aspect of the invention supporting an object.
Figure 1A:
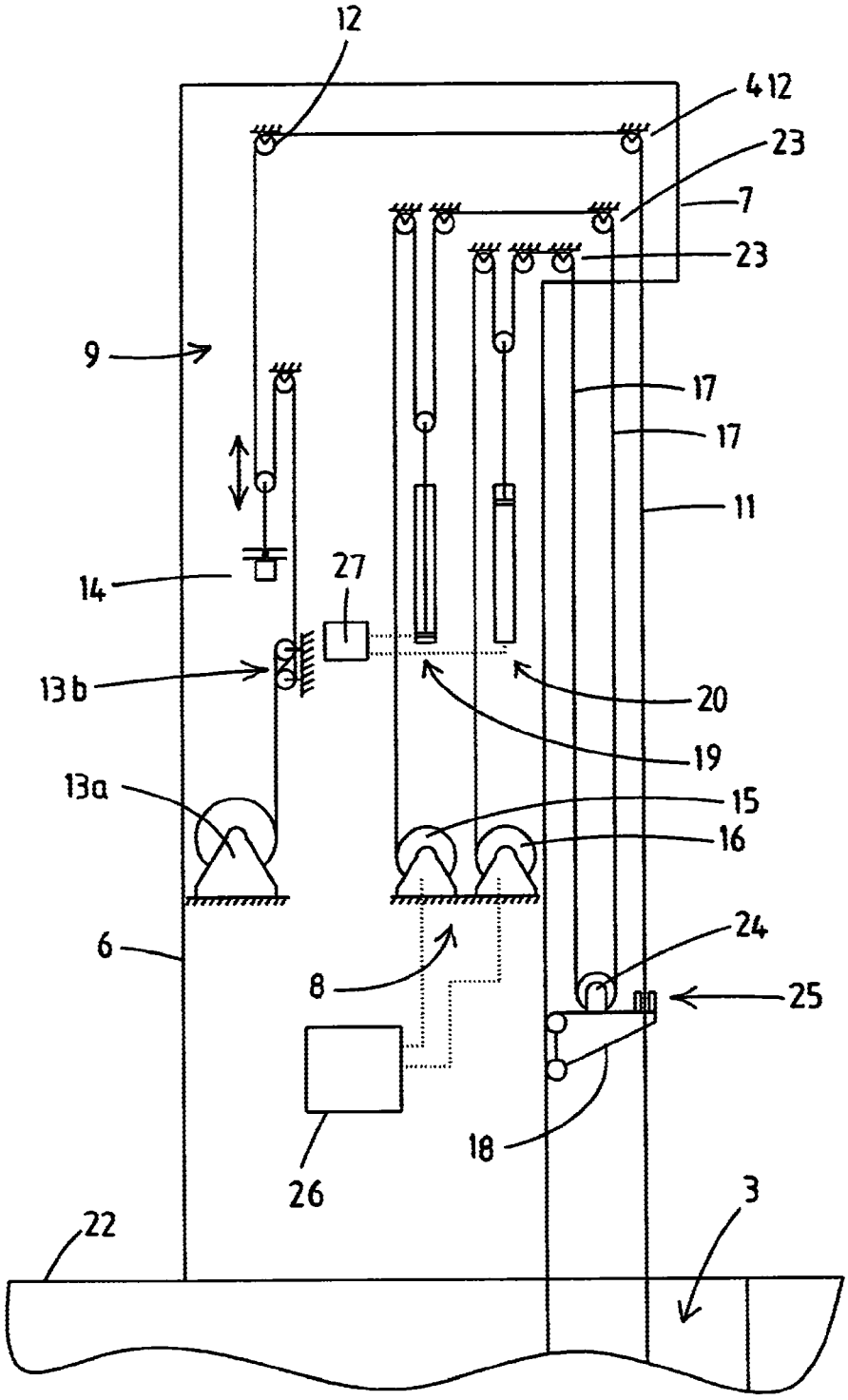
FIG. 1*a* shows a detail of FIG. 1.

FIG. 1 shows a side view in section of a vessel 1 provided with a multi purpose hoisting device, in the particular embodiment a drilling tower 2, according to the invention. A drilling tower is used in the off shore industry for supporting a drill string from a floating structure for drilling in the seabed. The vessel 1 depicted in FIG. 1 has a deck 22 and a moonpool 3. A moonpool is an opening in a hull of a floating structure providing access to the sea.

In the embodiment shown, the drilling tower 2 is located on the deck 22 next to the moonpool 3. In an alternative embodiment, the hoisting device can also be mounted on a vessel or floating structure without a moon pool, and for example be positioned along the side of the hull of the vessel or floating structure.

The drilling tower 2 comprises a load bearing structure, in the particular embodiment a mast 6. The top side of the mast 6 is formed by a mast head 7. The mast 6 comprises a main hoisting mechanism 8 and the deepwater hoisting mechanism 9.

With this particular drilling tower the main hoisting mechanism is used for composing a drill string out of separate pipe elements, and for supporting that drill string for drilling into the seabed.

The deepwater hoisting mechanism is used for lowering and lifting objects to and from deep water installation sites, for example for lowering an x-mas tree or sub sea manifold to a well. FIG. 1 shows the deepwater hoisting mechanism lowering an object 4, via the moonpool, to a deepwater installation site, in this case the seabed 5.

Figure 2:
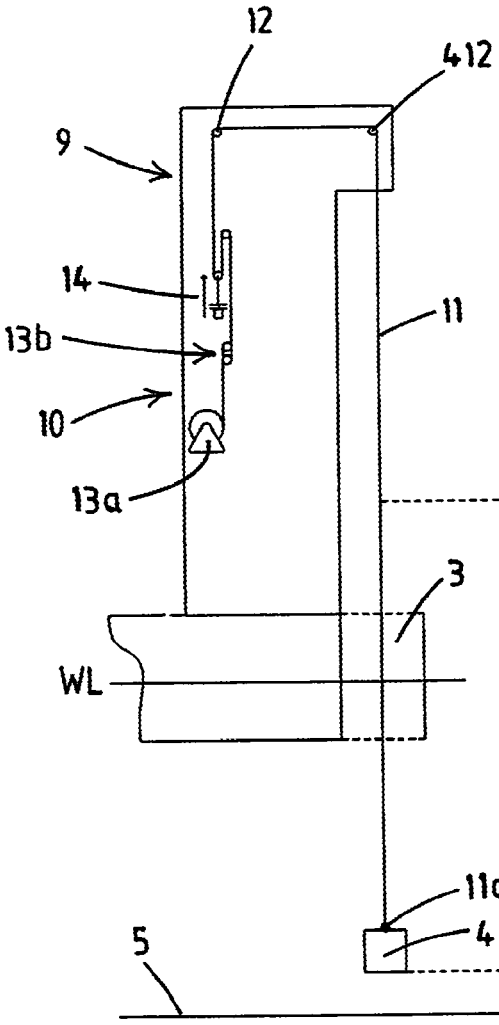
FIG. 2 shows the multi purpose hoisting device of FIG. 1 with only the deepwater hoisting mechanism depicted, the deepwater cable supporting an object.

FIG. 2 shows the drilling tower from FIG. 1 in which only the deepwater hoisting mechanism 9 is depicted. The deepwater hoisting mechanism comprises a deepwater hoisting winch 10, an associated deepwater hoisting cable 11, and an object connecting device 11*a*, for example a hook, for releasable connecting an object 4 to the deepwater hoisting cable 11.

A hoisting device according to the invention comprises a deepwater hoisting cable running along a path from the deepwater hoisting winch to a top pulley supported by the load bearing structure, from which top pulley the deep water hoisting cable is suspended for supporting a load, and which path of the deepwater hoisting cable is distinct from the main hoist heave compensation mechanism;

In the particular embodiment shown the deep water hoisting winch 10 comprises a storage hoisting winch 13A and a friction hoisting winch 13B. The storage hoisting winch 13A is used to store the deepwater hoisting cable 11. The friction hoisting winch 13B supports the weight of the free hanging end of the deep water hoisting cable 11 and the object 4 connected to the cable. The friction hoist 13B is used for lifting or lowering the deep water hoisting cable 11 and the supported object 4.

The deepwater hoisting cable 11 is guided from the deep water hoisting winch 13, comprising storage hoisting winch 13A and friction hoisting winch 13B, via cable pulley 12 to a top pulley 412 in the mast head 7 of the load bearing structure. From the top pulley 412 the deep water hoisting cable 11 is suspended for supporting a load. A section of the cable, also referred to as the free hanging section, hangs down into the moon pool 3.

In an alternative embodiment the storage hoisting winch 13A and a friction hoisting winch 13B are integrated into one deep water hoisting winch, which is used for supporting the load of the free hanging end of the deep water hoisting cable and any object supported by the cable as well as for lifting and lowering said cable and said object. In the following description the term "deep water hoisting winch" should be understood to encompass both the embodiment comprising a friction hoisting winch and a storage hoisting winch and the embodiment with a single hoisting winch.

The deepwater hoisting mechanism shown in FIG. 2 further comprises a cable tensioner 14 for preventing slack in the cable. A cable tensioner typically comprises a weight supported by a pulley which engages the cable is guided. The weight pulls down the cable and thus maintains tension in the cable.

For example when the vessel 1 moves in a downward direction while the deepwater hoisting cable is supporting an object, tension in the deepwater cable temporarily drops. This drop in tension may cause the deepwater cable to come loose from the pulleys. When the tension returns, the deepwater hoisting cable may end up next to the pulley and get stuck.

Figure 3:
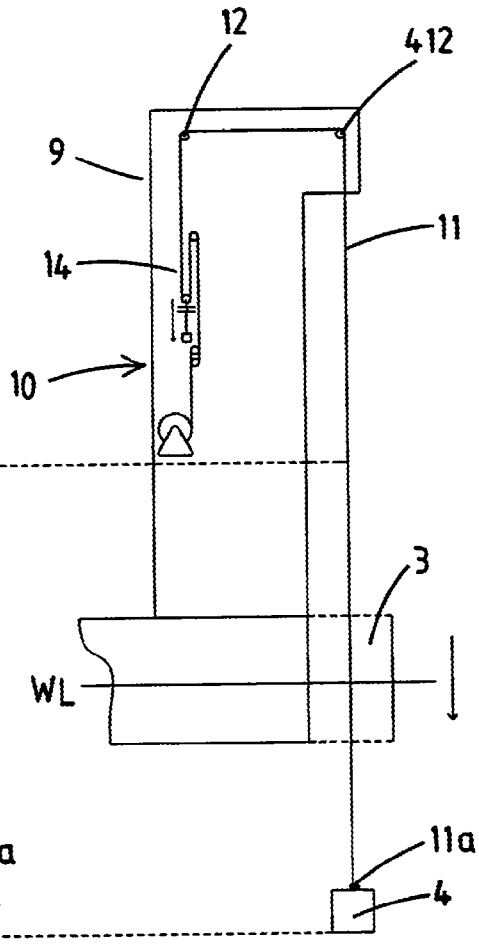
FIG. 3 shows the multi purpose hoisting device of FIG. 2 with cable tensioner for the deep water hoisting cable in operation.

FIG. 3 shows the vessel 1 moving in a downward direction compared to its position in FIG. 2, potentially causing lack of tension in the deepwater cable 11. However, the cable tensioner 14 moves in a downward direction and thus maintains tension in the cable 11, preventing it from coming loose from the pulleys 12, 412.

Cable tensioners are known in the art and are therefore not further elaborated upon in this text.

Figures 4, 5:
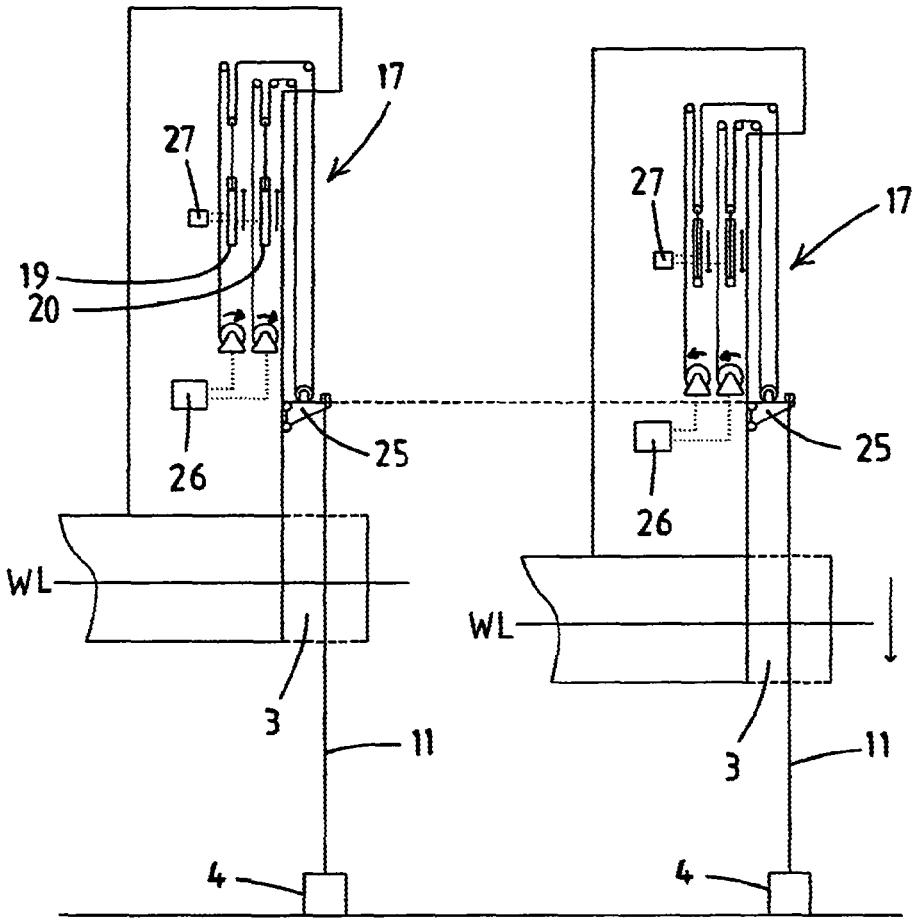
FIG. 4 shows the multi purpose hoisting device of FIG. 1 with only the main hoisting mechanism and a section of the deepwater hoisting cable depicted, the deepwater cable supporting an object.
FIG. 5 shows the multi purpose hoisting device of FIG. 4 with active heave compensation in operation.

FIG. 4 shows the multi purpose hoisting device or drilling tower from FIG. 1. In FIG. 4 only the main hoisting mechanism 8 for raising and lowering an object above the deck of the vessel is depicted. From the deepwater hoisting mechanism 9 only part of the free hanging section of the deepwater hoisting cable 11 is shown.

In the particular embodiment shown, the main hoisting mechanism 8 comprises a main hoisting cable 17 associated with a first main hoisting winch 15 and a second main hoisting winch 16. Each hoisting winch 15, 16 is connected with an end of the main hoisting cable 17. In an alternative embodiment, the main hoisting mechanism may comprise only one main hoisting winch or three or more main hoisting winches.

The main hoisting mechanism 8 further comprises an upper pulley block 23 supported by the load bearing structure 2 above the deck 22 of the vessel 1, and a travelling pulley block 24, which in the preferred embodiment shown is supporting a trolley 18.

Both pulley blocks 23, 24 comprise multiple pulleys, positioned parallel to the plane of the drawing (and thus do not show in FIG. 4). The main hoisting cable 17 is guided via the pulleys of the upper cable pulley block 23 and the pulleys of the travelling pulley block 24 in a multiple fall configuration, such that the moveable pulley block is moveable relative to load bearing structure or mast 2 by using at least one of the main hoisting winches 15, 16.

The travelling cable pulley block 24 comprises an object connecting device for releasable connecting an object to the travelling cable pulley block. In the embodiment shown, the travelling cable pulley block is connected to a trolley 18 which is provided with the object connecting device (not shown).

The trolley 18 is displaceable attached to the mast 6. The guided trolley can be moved along the mast 6 by using the main hoisting cable, and thus for example support a drill string or lift objects into and out of the moon pool.

Figure 12:
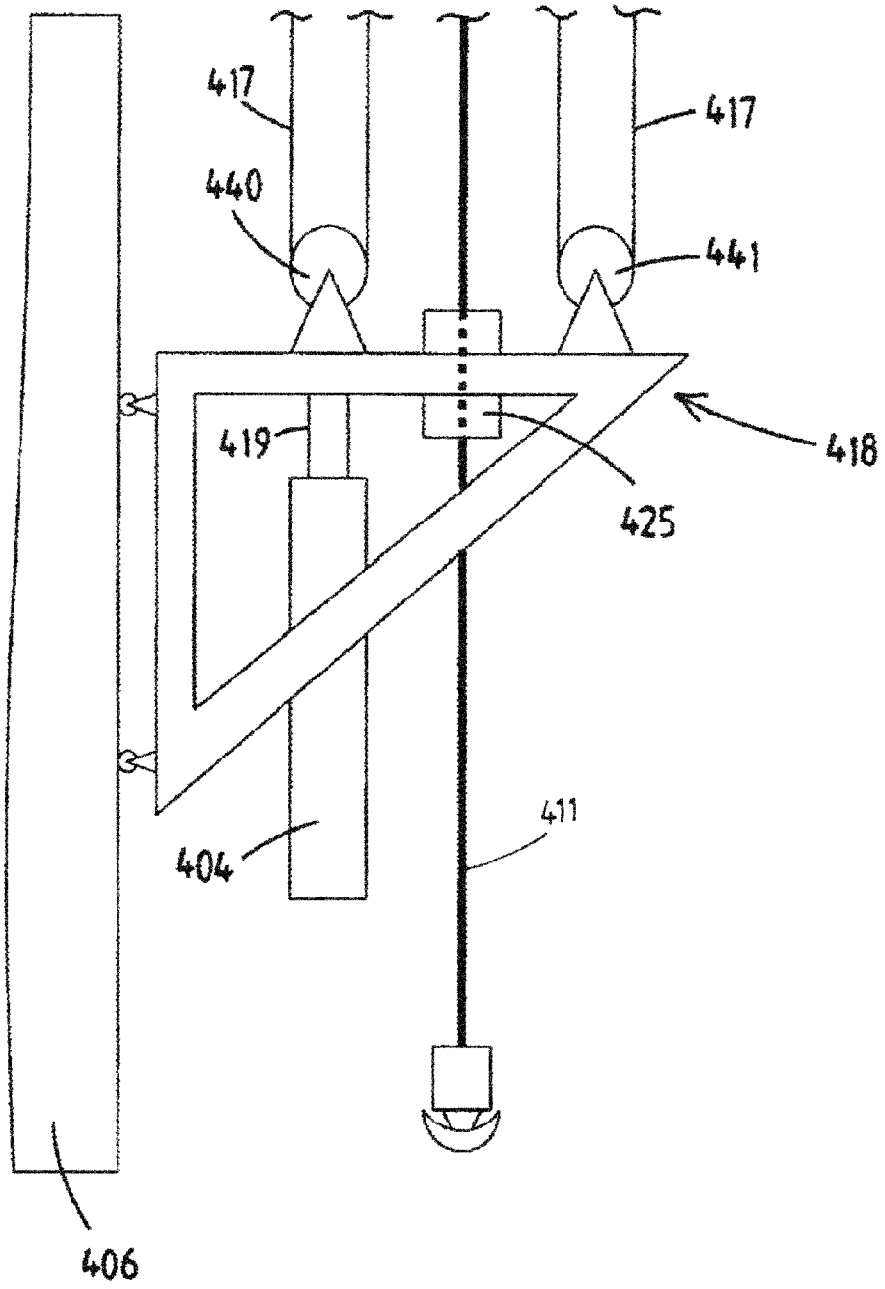
FIG. 12 shows a close up view of an alternative trolley.

FIG. 12 shows a close up of an alternative trolley 418 displaceable attached to a mast 406. The trolley comprises a releasable attachment mechanism 425 for interconnecting the main hoisting cable 417 and the deepwater hoisting cable 411.

The guided trolley 418 can be moved along the mast 406 by using the main hoisting cable 411, which is looped at the masthead 7 such that the trolley is supported via a first set of pulleys 440 and a second set of pulleys 441 at opposite sides of the deepwater hoisting cable and the releasable attachment mechanism. When the releasable attachment mechanism clamps the deep water hoisting cable, thus interconnecting the deep water hoisting cable 411 with the main hoisting cable 417, the load of the object supported by the deepwater hoisting cable is transferred via the trolley to the main hoisting cable. Since the trolley is supported at opposite side of the releasable attachment mechanism, the load is supported more equally by the main hoisting cable, preventing excessive torque in the trolley construction and preventing the trolley from tipping in a clockwise direction.

It is observed that in the preferred embodiment shown, the trolley 418 furthermore is provided with a an object connecting device 419 for releasable connecting an object, for example a top drive 404 for supporting and driving a drill sting (not shown). In the preferred embodiment shown, the object connecting device 419 is located in line with the first set of pulleys 440, such that a load supported by the object connecting device is optimally transferred to the main hoisting cable, not causing a torque tipping the trolley.

The main hoisting mechanism 8 shown in FIG. 4 furthermore comprises a heave compensation mechanism associated with the main hoisting cable 17 for damping the effect of the movement of the vessel, as a result of heave and beating of waves, onto an object 4 supported by the main hoisting cable 17.

The heave compensation mechanism in the particular embodiment shown is designed for providing active as well as passive heave compensation. The heave compensation system comprises an electronic system 26 provided with sensors (not shown) for detecting heave. The electronic system 26 is designed for driving the main hoisting winches for actively damping at least part of the vertical movement of the vessel with respect to a load supported by the main hoisting cable, more in particular with respect to a load supported by the trolley 18.

The heave compensation mechanism is further provided with an underload protector 19 and an overload protector 20 for protecting the hoist mechanism during active heave compensation. Both underload and overload protector are provided in the form of a hydraulic cylinder which each support a cable pulley. The main hoisting cable 17 is guided over these pulleys such that the cylinders can enact a force upon the cable via the cable pulleys.

The underload protection is used to prevent damage caused for example by sudden loss of tension in the hoisting cable. For example when the tension in the main hoisting cables suddenly lapses because a load is disconnected, the release of tension may cause the hoisting cable to slack and come loose from one more cable pulleys. When the main hoisting cable is subsequently loaded again, the cable may end up besides the cable pulley, damaging the hoisting mechanism.

The underload protection shown is formed by a cylinder. Under normal conditions the force enacted by the main hoisting cable upon the cylinder is sufficient to keep the cylinder rod in the extended state. When the tension in the main hoisting cable drops, the force exerted by the cylinder on the cylinder rod is enough to draw in the cylinder, preventing the cable to come loose from the pulleys.

Like the underload prevention, the overload prevention shown is formed by a cylinder also. In contrast to the underload prevention, the cylinder rod is in fully retracted state under normal conditions. Only when the force the main hoisting cable surpasses a threshold value, it will extend, preventing the tension in the cable from becoming high enough to do damage to the hoisting mechanism.

The heave compensation system is further provided with a control device 27 for controlling the underload protection cylinder and the overload protection cylinder. The control device is adapted to switch the cylinders between a protection mode in which they protect the hoisting mechanism against underload or overload respectively, and a heave compensation mode in which the cylinders provide passive heave compensation. In the underload and overload mode the cylinders are positioned in the fully extended and the fully retracted position, and in the passive heave compensation mode each cylinder is positioned in intermediate position.

Preferably, the control device is equipped to change the position of the cylinders by changing the pressure in the cylinders. In such an embodiment, a gas reservoir is connected to the heave compensation cylinders, as is usual for heave compensation devices. Furthermore, a pressure control device is present to adjust the gas pressure.

Thus, with the preferred heave compensation mechanism shown, the cylinders can be switched from the overload and underload protection mode into passive heave compensation mode. In the passive heave compensation mode the cylinder rods are positioned inbetween the retracted and extended state.

The main hoisting mechanism 8 according to the invention furthermore comprises a releasable attachment mechanism 25 for interconnecting the main hoisting cable 17 and the deepwater hoisting cable 11. In this way a object supported by the deepwater hoisting cable can be lifted and lowered using the main hoisting mechanism, including the heave compensation mechanism.

In the preferred embodiment shown, the releasable attachment mechanism 25 is part of the trolley 18. The deepwater cable 11 is connected to the main hoisting cable 17 via the trolley 18 and the travelling cable pulley block 24. In an alternative embodiment the releasable attachment mechanism is part of the travelling cable pulley block 24.

Preferably the trolley and/or the travelling pulley block are/is provided with a guiding device, for example a circular guide opening, for guiding the deepwater hoisting cable when the latter is supporting an object. The guiding device positions the deepwater hoisting cable with respect to the releasable attachment mechanism to facilitate interconnecting the main hoisting cable and the deepwater hoisting cable.

In the preferred embodiment shown, the trolley is provided with a conically shaped opening or through hole (not shown), which is positioned in line with the free hanging end of the deepwater cable. Thus the cable can be lowered via the hole into the water.

When the deepwater hoisting cable is to be connected to the main hoisting cable, wigs are to be placed inbetween the walls of the through hole and the deepwater hoisting cable. To release the deep water hoisting cable, the wigs are removed. In this embodiment the guide device or through hole is part of the releasable attachment mechanism.

The multi purpose hoisting device according to the invention and shown in FIGS. 1-7 thus comprises two types of hoisting mechanisms, each having a specific function and one heave compensation mechanism and one heave compensation mechanism.

The first hoisting mechanism is the main hoisting mechanism for lifting loads in and out of the moonpool and above the deck of the vessel, but also for supporting for example a drill string extending from the vessel to the seabed.

The second hoisting mechanism is the deepwater hoisting mechanism for lifting and lowering a load in deepwater, for example for placing a well head on the seabed.

The heave compensation mechanism is part of the main hoisting mechanism. However, by connecting the main hoisting cable and the deepwater hoisting cable, the heave compensation mechanism can also be used when lifting or lowering an object with the deepwater hoisting mechanism.

When lowering objects with the deep water hoisting mechanism, these may be provided on the deck of the vessel. The object is connected to the deepwater hoisting cable, lifted from the deck of the vessel and subsequently lowered by the deepwater hoisting mechanism via the moonpool to the under water installation site. Heave compensation is only necessary along the last meters of the trajectory.

Large objects, such as a template, will typically be provided in an under water position. For example a vessel dedicated to transporting large objects will lower the template in to the water using a main hoisting crane for lifting and lowering objects near the water surface. The object is subsequently lowered in a first intermediate underwater position in a near surface zone, preferably ranging from the water surface up to a depth of 50 meters. Preferably this position is located at a depth beneath what is called "the wave action effect zone", so that the wave action does not significantly affect the stability of the object in this position.

Subsequently the deep see hoisting cable is interconnected to the object, which is than further lowered by the hoisting crane of the transport vessel into a second intermediate underwater position in which the object is fully supported by the deepwater hoisting cable. Then, the hoisting cable of the hoisting crane on the transport vessel is disconnected such that the object is only connected to the deepwater hoisting cable.

This second intermediate position is preferably still within the near surface zone, such that the object is still very close to the surface compared to the position of the deepwater installation site which is typically located at a depth of a 1000 meters or more.

The object is subsequently lowered, using the deepwater hoisting means, from the second intermediate underwater position to a third intermediate underwater position near the deepwater installation site.

Thus the object is lowered over a distance of for example a 1000 meters or more, from the near surface zone to a near installation site zone, which zone preferably ranges from the installation site in an upward direction over a distance of about 50 meters.

In most situations the object is to be landed on an installation site which is an earthbound structure, or even the seabed itself. In other cases the object needs to be supported in a specific depth such that it can be attached, for example, to the side of an earthbound structure. To allow for evenly and accurate lowering and/or positioning of the object heave compensation should be used.

When the object is in the third intermediate underwater position, the lowering is stopped and the deepwater hoisting cable is connected to the main hoisting mechanism, or, in the particular case shown, to the trolley of the main hoisting mechanism. This situation is shown in FIG. 1. FIG. 4 shows the same situation in more detail. For the sake of clarity, only the main hoisting mechanism and the part of the deepwater hoisting cable supporting the load are depicted.

After the main hoisting cable is connected to the trolley, the trolley is lifted to transfer the weight of the object from the deepwater winch, or in the particular case shown from the deepwater friction winch, to the main hoisting winch. When the object is supported by the main hoisting mechanism, the heave compensation is activated.

FIG. 5 shows the active heave compensation which compensates for the vessel moving in a downward direction compared to the position shown in FIG. 4. The electronic control system registers the movement of the vessel in a downward direction. In reaction to this movement, the electronic system drives the winches supporting the main hoisting cable to rotate counter clockwise and take in the main hoisting cable to keep the object at a constant depth.

When the vessel moves in an upward direction, the electronic system drives the winches in the opposite direction.

The active heave compensation allows for lifting or lowering the object supported by the main hoisting mechanism at a controlled speed. Thus the object is lowered from the third intermediate underwater position onto the deepwater installation site, in this case the seabed, at a constant speed. This prevents the object from slamming into the seabed and getting damaged.

It is observed that the object is still supported by a section of the deepwater hoisting cable. However the load of this section of the deepwater hoisting cable and the object are know supported by the main hoisting winches. To allow the main hoisting winches to lower the object to the seabed, the deepwater hoisting mechanism pays out deepwater hoisting cable. The deepwater cable is preferably paid out at a speed in line with the lowering speed of the main hoisting mechanism such that the tension in the deepwater cable not supporting the object remains constant.

When the object is landed on the seabed, preferably the heave compensation mechanism changes form active heave compensation into passive heave compensation. In the preferred embodiment shown this is achieved by the control device 27 switching the cylinders into from protection mode into passive heave compensation mode. In this mode, the rods of the cylinders are positioned in a half extend position. In this mode the cylinders compensate for reduction or increase in tension in the main hoisting cable due to the vessel moving up and down relative to the object positioned on the seabed, and there is no heave compensation provided by the main hoisting winches.

Figures 6, 7:
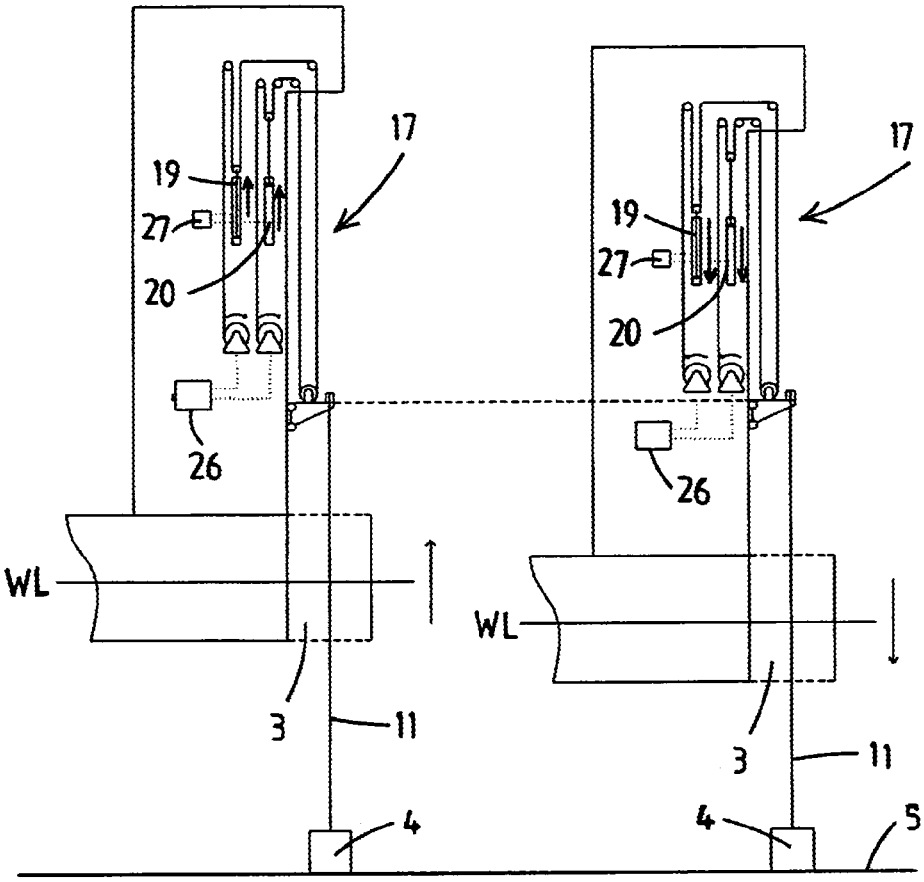
FIG. 6 shows the multi purpose hoisting device of FIG. 4 with overload protection in operation.
FIG. 7 shows the multi purpose hoisting device of FIG. 4 with underload protection in operation.

This situation is shown in FIGS. 6 and 7 in which both cylinders extend and retract to keep the tension in the main hoisting cable substantially normal when the vessel moves up (shown in FIG. 6) and the vessel moves down (shown in FIG. 7) respectively.

Subsequently the object may be lifted to the surface again. In this case the previous described steps will commence in reverse order. The object is first lifted form the installation site active using heave prevention. When it is lifted from the installation site over such a distance that there is nor risk of the object slamming into the side, the heave compensation is switched off. Subsequently, the deepwater hoisting cable is disconnected form the main hoisting cable, and the object is lifted using the deepwater hoisting mechanism from the near installation site zone to the near surface zone.

When leaving the object at the seabed, the deepwater hoisting cable is disconnected and subsequently retrieved. Preferably it is lifted using active heave compensation such that it does not slam into the object. When the cable is clear form the object, active heave compensation is switched off, the deepwater cable is disconnected from the main hoisting cable and retrieved using the deepwater hoisting mechanism.

Figure 8:
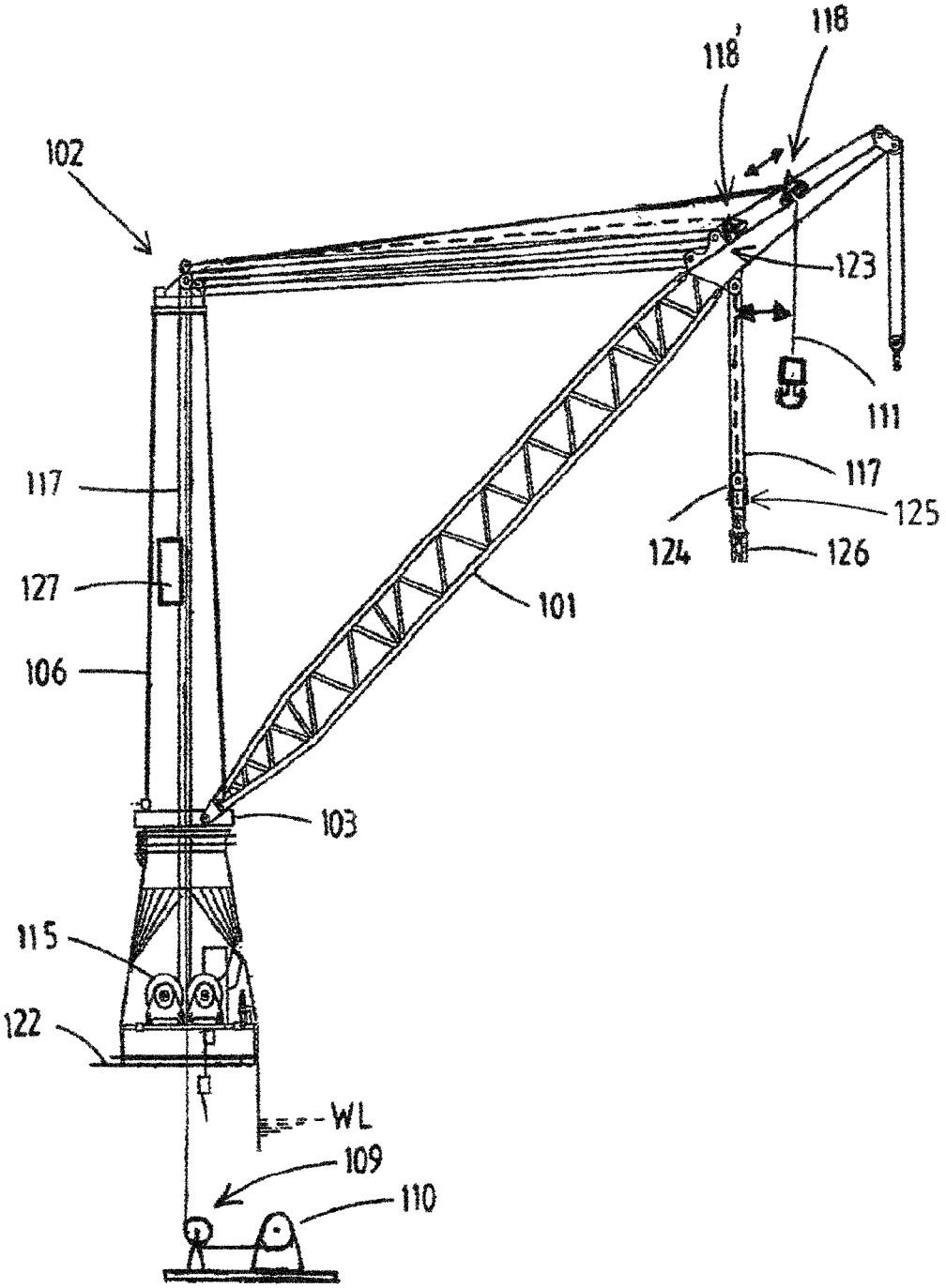
FIG. 8 shows an alternative multi purpose hoisting device according to the invention.

It is observed that the first aspect of the invention can be used with different types of cranes or hoisting devices. For example, FIG. 8 shows a hoist crane 102 according to the invention. The hoist crane 102 is provided with a load bearing structure in the form of a substantially hollow vertical column 106 witch is attached to the deck 122 of a vessel via a foot. The hoist crane 102 is further provided with a jib 101. An annular bearing structure 103 extends around the vertical column and guides and carries a jib connection member, so that the jib connection member, and therefore the jib, can rotate about the column.

In the particular embodiment shown, the jib connection member forms a substantially horizontal pivot axis, so that the jib can also be pivoted up and down. To pivot the jip up and down, topping mechanisms are provided comprising a jib winch and a jib hoisting cable.

Furthermore, the hoist crane comprises main hoisting mechanism 108, comprising a main hoisting winch 115 and a main hoisting cable 117, and a deepwater hoisting mechanism 109, comprising a deepwater hoisting winch 110 and an associated deepwater hoisting cable 111. The main hoisting winch 115 is located in the foot of the crane and the deepwater hoisting winch 110 is located in the hull of the vessel.

The main hoisting cable 117 and the deepwater hoisting cable 111 are guided along cable pulleys in the top of the mast 106 and cable pulleys in the jib 101 for supporting free hanging sections of the main hoisting cable and the deepwater hoisting cable at a distance from the mast 106. The pulleys in the jib supporting the main hoisting cable form an upper cable pulley block 123. The jib supports the upper cable pulley block 123 at least 20 meters above the deck 22 of the vessel. The main hoisting cable 117 is guided via the pulleys of the upper cable pulley block 123 and the pulleys of a travelling cable pulley block 124 in a multiple fall configuration.

The travelling cable pulley block is provided with an object connecting device 126 in the form of a hook, for releasable connecting an object to a travelling cable pulley block 124.

In the embodiment shown the deepwater hoisting cable 111 is supported by a top cable pulley which is mounted on a trolley 118 which is movable attached to the jib. The crane is furthermore provided with a drive (no shown) for moving the trolley along the jib. Thus the deepwater hoisting cable is moveably supported by the load bearing structure, more in particular the trolley 118.

The free hanging section of the deepwater hoisting cable, hanging down form the top pulley, can be moved relative to the main hoisting cable in a horizontal direction between a first position and a second position. In the first position, shown in full lines in FIG. 8, the free hanging section of the deepwater hoisting cable is positioned at a distance from the main hoisting cable. In the second position, shown in dotted lines in FIG. 8, the free hanging end of the deepwater hoisting cable is positioned close to the main hoisting cable such that they can be interconnected.

The main hoisting mechanism 108 further comprises a heave compensation mechanism 127 associated with the main hoisting cable for damping the effect of the movement of the vessel onto a object supported by the main hoisting cable 117. In the embodiment shown, the heave compensation mechanism is located in the mast 106.

According to the invention the heave compensation mechanism of the main hoisting mechanism can be used with the deepwater hoisting mechanism also. Therefore, in the embodiment shown in FIG. 8, the travelling cable pulley block 124 is provided with a releasable attachment mechanism 125 for interconnecting the main hoisting cable 117 and the deepwater hoisting cable 11, when the latter is in the second position.

The travelling pulley block is furthermore provided with a U-shaped, when seen in top view, guiding opening for receiving the deepwater hoisting cable when moved into the second position. In this position, the deepwater hoisting cable can be used for lifting and lowering an object. While lifting or lowering the object, the deepwater cable runs via the opening in the travelling cable pulley block which is in a stationary position.

When the load supported by the deepwater hoisting device needs heave compensation, the releasable attachment mechanism located on the travelling pulley block engages the deepwater hoisting cable such that the deepwater hoisting cable and the main hoisting cable are interconnected. Subsequently the main hoisting mechanism is used to support the weight of the deepwater hoisting cable and the object, and to lift and lower the object. When the load of the deepwater cable and the object are supported by the main hoisting mechanism, the heave compensation mechanism is able to provide heave compensation.

According to the first aspect of the invention, also a method for lowering an object from a floating vessel to a deepwater installation site is provided, in which method use is made of a multi purpose hoisting device, preferably a multi purpose hoisting device as described above.

This hoisting device comprises a main hoisting mechanism, a deepwater hoisting mechanism, and a releasable attachment mechanism.

The main hoisting mechanism is designed for raising and lowering an object near the water surface, preferably for raising and lowering the object above a deck of the vessel. This main hoisting mechanism is thus preferably able to lift an object from a position in the water to a position above the deck of the vessel.

The main hoisting mechanism comprises at least one main hoisting winch, a main hoisting cable associated with the at least one main hoisting winch, and a connecting mechanism for releasable connecting an object to the main hoisting cable.

The main hoisting mechanism furthermore comprises a heave compensation mechanism associated with the main hoisting cable for damping the effect of the movement of the vessel, as a result of heave and beating of waves, onto an object supported by the main hoisting cable.

The deepwater hoisting mechanism is designed for raising and lowering an object to a deepwater installation site, preferably to an installation site at a depth of 1 km or more.

The deepwater hoisting mechanism comprises a deepwater hoisting winch, an associated deepwater hoisting cable, an object connecting device for releasable connecting an object to the deepwater hoisting cable.

The deepwater hoisting cable runs along a path from the deepwater hoisting winch to a top pulley supported by the load bearing structure of the hoisting device, from which top pulley the deep water hoisting cable is suspended for supporting a load. The path of the deepwater hoisting cable is distinct from the main hoist heave compensation mechanism.

The hoisting device furthermore comprises a releasable attachment mechanism designed for interconnecting the main hoisting cable and the deepwater hoisting cable such that the heave compensation mechanism associated with the main hoisting cable is operable in combination with the deepwater hoisting cable, which method comprises.

The method involves lowering an object from a position near the water surface to an intermediate underwater position near the under water installation site, preferably within 50 meters of the deepwater installation site. For this first part of the trajectory the deepwater hoisting winch and the associated deepwater hoisting cable are used.

Prior to landing the object on the deepwater installation site, the deepwater cable is interconnected with the main hoisting cable. Subsequently the load of the deepwater cable and the supported object are transferred from the deepwater hoisting device, in particular the deepwater hoisting winch, or, if present the deepwater friction winch, to the main hoisting device, in particular the main hoisting winch. The load is moved from the deepwater mechanism to the main hoisting mechanism by either paying out extra deepwater cable or by paying man hoisting cable, or by a combination of both.

In a preferred embodiment, the heave compensation is designed such that it can be turned off, in which condition no heave compensation is provided, and turned on, in which condition the heave compensation mechanism provides heave compensation. When the heave compensation mechanism of the main hoisting mechanism is of such a design, it is preferably turned of when the main hoisting cable and the deepwater cable are connected, and is turned on after the load of the deepwater hoisting cable and the supported object are transferred to the main hoisting mechanism, in particular to the main hoisting winch.

Subsequently, the object is lowered from the intermediate underwater position to the under water installation site using the main hoisting winch. Since the object and the section of the deepwater cable connecting the object to the main hoisting cable, more in particular to the releasable attachment mechanism, are supported by the main hoisting winch, heave compensation can be provided using the main hoist heave compensation mechanism.

The heave compensation mechanism of the main hoisting mechanism is used to compensate for movements of the vessel relative to the deepwater installation site while lowering the object and landing the object on the deepwater installation site.

In a preferred embodiment, the heave compensation mechanism is designed to provide active heave compensation as well as passive heave compensation. When such a heave compensation mechanism is used, preferably active heave compensation is provided while lowering the object. When the object is landed on the deepwater installation site, the heave compensation mechanism is switched form active heave compensation to passive heave compensation.

The method thus allows for accurate placement of the object onto the deepwater installation site. Furthermore, it allows for using only a single heave compensation mechanism in combination with both a main hoisting mechanism and the deepwater hoisting mechanism. This saves space, weight and money.

The method is suitable for all sorts of activities, such as: template installation, wellhead installation, jumper installation, etc.

In a further preferred method according to the invention, the object is connected to the installation site, prior to landing the object, to further eliminate the effects of the heaving of the vessel onto the position of the object supported by the hoisting device. The winch or connection cable is connected to the installation site for example by welding the winch to a structure of the deepwater installation site or by fixing the connection cable to the seabed, for example by using an anchor.

This method involves connecting the object to the deepwater installation site, preferably when the object is positioned in the intermediate underwater position, via a connection cable associated with a winch.

When the object is supported by the main hoisting mechanism and the deepwater hoisting cable, the connecting cable is tensioned using the winch and thus exerting a force on the object in a substantial vertical direction. The tensioning of the connecting cable exerts a force upon the main hoisting cable acting against the force exerted by the heave compensation mechanism.

Due to the tensioning of the connection cable, the object is pulled to the deepwater installation site and landed on the deepwater installation site.

Optionally, in addition to the tensioning of the connection cable, the object is lowered by releasing the passive heave compensation and/or lowering the main hoisting cable while maintaining tension in the connecting cable.

The method of compensating heave by connecting the object to the deepwater installation site in addition to using the heave compensation mechanism of the main hoisting mechanism is especially suited when lowering objects at great depth.

According to a second aspect of the invention, a hoisting device for use on a floating vessel is provided. The hoisting device comprises a load bearing structure to be mounted on the vessel, a hoisting mechanism for raising and lowering an object, an object connecting device, preferably a hook, for releasable connecting an object to the hoisting cable, and a heave compensation mechanism.

The hoisting mechanism comprises at least one hoisting winch and a hoisting cable associated with the at least one hoisting winch.

The heave compensation mechanism is associated with the hoisting cable for damping the effect of the movement of the vessel, as a result of heave and beating of waves, onto a object supported by the main hoisting cable. The heave compensation mechanism comprises an electronic system for detecting heave and for driving the at least one hoisting winch for providing active heave compensation;

The heave compensation mechanism further comprises an underload protection cylinder and/or an overload protection cylinder.

The underload protection cylinder supports a cable pulley which guides the hoisting cable such that a force can be exerted upon the hoisting cable. The underload protection cylinder is positioned in an essentially extended position to protect the hoisting mechanism against underload or slack.

The overload protection cylinder supports a cable pulley which guides the hoisting cable such that a force can be exerted upon the hoisting cable. The overload protection cylinder is positioned in an essentially retracted position to protect the hoisting mechanism against overload.

The hoisting mechanism preferably comprises an electronic system for detecting heave and for driving the at least one hoisting winch for providing active heave compensation.

The hoisting mechanism further comprises a control device 27 for controlling the underload protection cylinder and/or the overload protection cylinder, which control device is adapted to switch each of the cylinders 19,20 between a protection mode in which said cylinder protects the hoisting mechanism against underload or overload respectively, and a heave compensation mode, in which each cylinder is positioned in intermediate position to provide passive heave compensation.

Preferably, the control device is equipped to change the position of the cylinders by changing the pressure in the cylinders. In such an embodiment, a gas reservoir is connected to the heave compensation cylinders, as is usual for heave compensation devices. Furthermore, a pressure control device is present to adjust the gas pressure.

The underload protection cylinder and/or the overload protection cylinder are thus adapted to be switched between a protection mode and a heave compensation mode. When the heave compensation mechanism provides active heave compensation, the cylinder are set in the protection mode to protect the hoisting mechanism against underload or overload.

When the heave compensation mechanism provides passive heave compensation, the cylinder are set in the heave compensation mode, in which the cylinder rods are in a half retracted, half extended position (when not compensating).

In a preferred embodiment the cylinders can also be switched between overload protection mode and underload protection mode. Thus a complete heave compensation system providing active as well as passive heave compensation can be composed using this one type of cylinders only. Using a limited type of cylinders means that less replacement cylinders have to be kept on hand. Furthermore, producing a single type of cylinders is less expensive than producing two or even three different types of cylinders. Using these multi mode cylinders thus allows for lower operational costs and low production costs.

Figure 9:
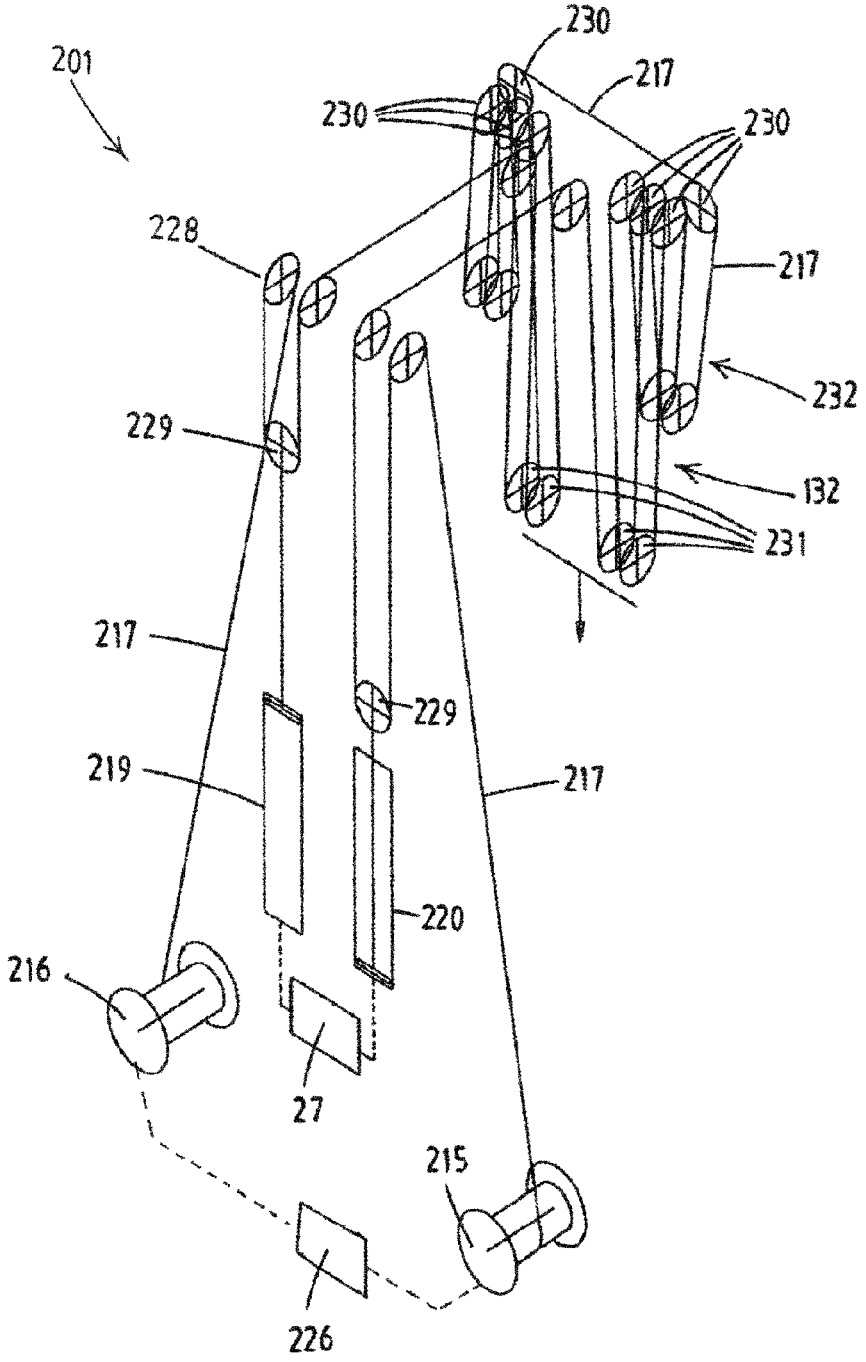
FIG. 9 shows a heave compensation system according to a second aspect of the invention in an active heave compensation mode and with overload and underload protection.

FIG. 9 schematically shows a heave compensation system 201 according to the second aspect of the invention. For the sake of clarity not all the elements of the hoisting device are shown.

The heave compensation system 201 comprises a hoisting cable 217 which is at both ends connected to a hoisting winch 215, 216. An electronic system is provided 226 for detecting heave and for driving the hoisting inches to enable active heave compensation.

The hoisting cable 217 is guided via pulleys 228 mounted on the load bearing structure over the pulleys of the cylinders 219, 220.

The hoisting cable 217 is further guided via pulleys 230 of an upper cable pulley block 23 (not shown) supported by the load bearing structure, and the pulleys 231 of a travelling pulley block 24 (not shown) in a multiple fall configuration 132. The travelling cable pulley block 24 is moveable relative to the load bearing structure 6, and to the upper cable pulley block, by using at least one main hoisting winch 15, 16.

In FIG. 9 the cylinders 219, 220 are set in the underload and overload protection mode. The underload protection cylinder 219 is positioned in the substantially extended position, and the overload protection cylinder in the substantially retracted position.

The heave compensation mechanism further comprises a control device 27 for controlling the underload protection cylinder and the overload protection cylinder, which control device is adapted to switch each of the cylinders 219,220 between a protection mode in which said cylinder protects the hoisting mechanism against underload or overload respectively, and a heave compensation mode, in which each cylinder is positioned in intermediate position to provide passive heave compensation.

Figure 10:
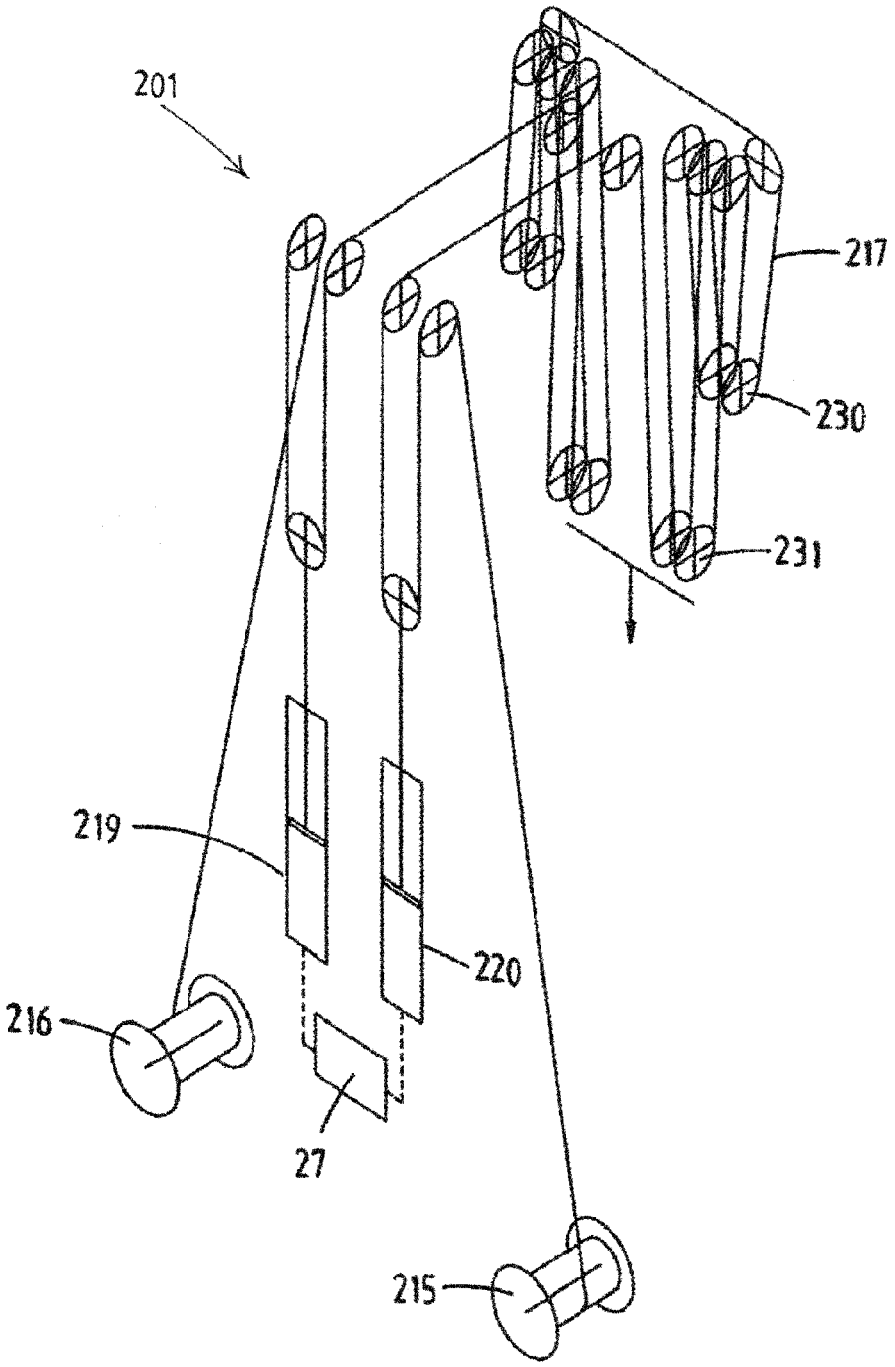
FIG. 10 shows the heave compensation of FIG. 9 in a passive heave compensation mode.

FIG. 10 shows the heave compensation mechanism of FIG. 9 with the cylinders in passive heave compensation mode such that the heave compensation mechanism can provide passive heave compensation. In this configuration both cylinders are in a half extended position.

The cylinders are preferably switched between modes of operation by changing the internal pressure in the cylinder. Preferably, the control device is equipped to change the position of the cylinders by changing the pressure in the cylinders. In such an embodiment, a gas reservoir is connected to the heave compensation cylinders, as is usual for heave compensation devices. Furthermore, a pressure control device is present to adjust the gas pressure.

Figure 11:
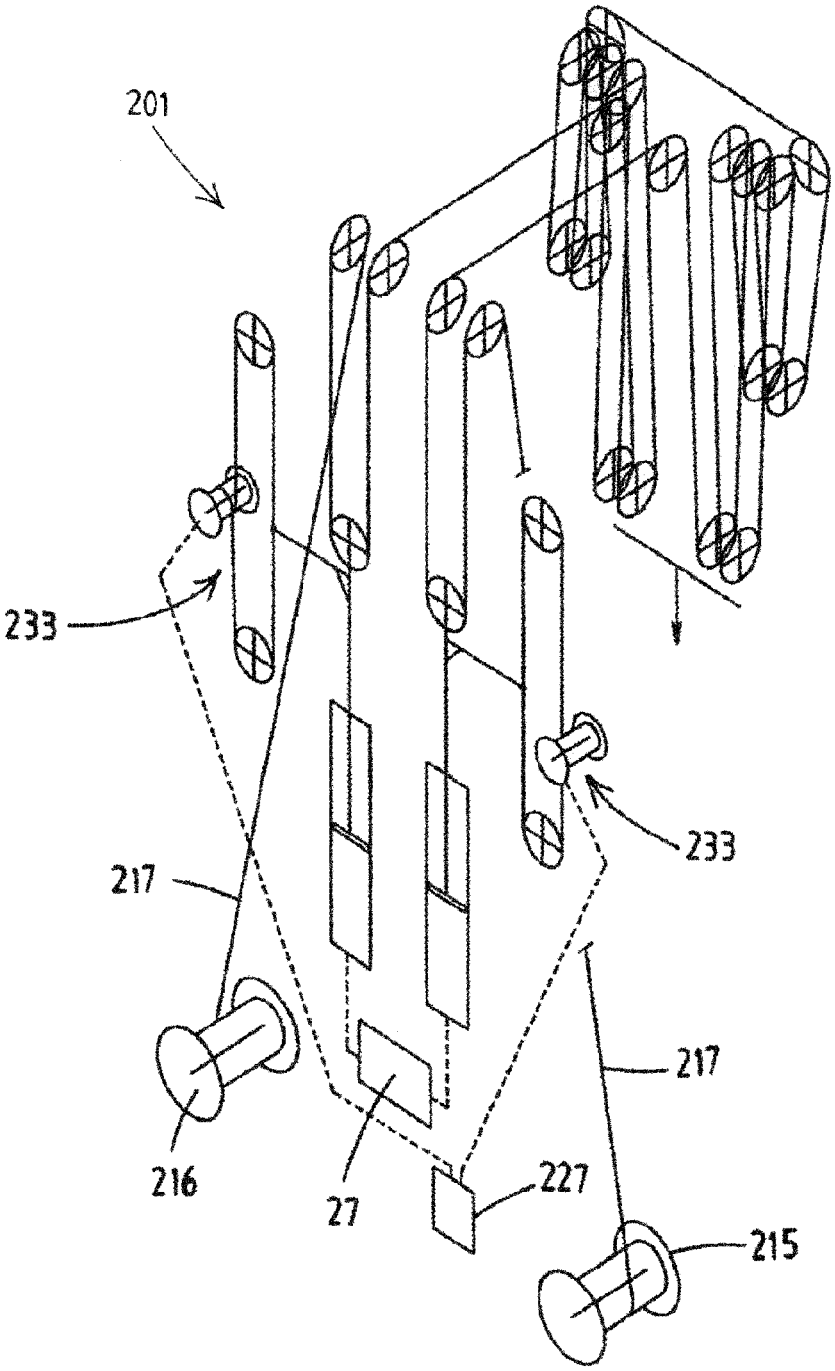
FIG. 11 shows an alternative heave compensation mechanism.

In a preferred embodiment, show in FIG. 11, one or more cylinders are provided with a drive 233 for moving the cylinder rod in the cylinder, which drive is controlled by the electronic system 227 to provided active heave compensation by providing a force upon the cylinder rod of the cylinder. The drive is connected to the cylinder rod via a cable guided by at least two pulleys.

In such a hoisting mechanism preferably the one or more cylinders provide about 80% of the heave compensation and wherein the electronic system in combination with the heave compensation drive connected to the cylinders provides about 20% of the heave compensation.

A multi purpose hoisting device according to the first aspect of the invention comprises two types of hoisting mechanisms, each having a specific function. The first hoisting mechanism is the main hoisting mechanism for lifting loads in and out of the moonpool and above the deck of the vessel, but also for supporting for example a drill string extending from the vessel to the seabed. The second hoisting mechanism is the deepwater hoisting mechanism for lifting and lowering a load in deepwater, for example for placing a well head on the seabed. Both types of hoisting mechanism are combined in one supporting structure, such as a mast or tower. Furthermore, the hoisting mechanism and/or the heave compensation mechanism may be located in the load bearing structure, or, for example, in the hull or on the deck of the vessel on which the load bearing structure is mounted.

In the particular embodiments shown in FIGS. 1-7 the travelling cable pulley block is connected to a trolley. The trolley is provided with a guide for guiding the deepwater hoisting cable which guide is also part of the releasable attachment mechanism, in this case a clamping mechanism, for connecting the main hoisting cable with the deepwater hoisting cable. The trolley is furthermore provided with an object connecting device for connecting objects the trolley to objects, and thus connecting the objects via the travelling pulley block to the main hoisting cable. Thus, the objects can be lifted or lowered using the main hoisting winches.

In an alternative embodiment, the guide, releasable attachment mechanism and object connecting device may be distributed in other configurations. For example, the guide and releasable attachment mechanism may be part of the travelling pulley block, while the object connecting device is part of the trolley.

Alternatively all three may be part of the travelling pulley block. In such a configuration no trolley is present or the travelling pulley block may be releasable connected to the trolley. By disconnecting the travelling pulley block from the pulley the working range of the main hoisting mechanism can be increased.

In a further embodiment, the trolley or travelling pulley block is provided with a releasable attachment mechanism which is also used for connecting the object connecting device to the respective trolley or cable pulley block. For example, the releasable attachment mechanism is a hydraulic clamp for clamping the deepwater hoisting cable, which clamp is also be used for holding the object connecting device, for example a hook.

In a further embodiment, the releasable attachment mechanism and the object connecting device may be integrated in one device, for example a clamp which is used for clamping the deepwater hoisting cable as well as for clamping objects to be lifted or lowered by the main hoisting mechanism.

In the embodiment shown in FIG. 8 the main hoisting cable and the deepwater hoisting cable are both supported by a jib. The deepwater cable is supported on a moveable trolley such that it can be moved in a horizontal direction, indicated with arrow, relative to the main hoisting cable between a first position and a second position.

In an alternative embodiment, only the deepwater hoisting cable is supported by a jib, along the lines of the embodiment shown in FIG. 8, and the main hoisting cable is supported by the load bearing structure, along the lines shown in FIG. 1-7. In such an embodiment the deepwater hoisting cable can be moved relative to the main hoisting cable by pivoting the jib.

In the particular embodiments shown in the figures, the load bearing structure is embodied in a drilling tower or mast of a crane. However, the load bearing structure can be of many shapes and sizes. For example, the load bearing structure can be a frame work structure or a mainly closed structure such as a tower or mast.

In a preferred embodiment according to the invention, the hoisting device is provided with travelling cable pulley block, and optionally a trolley connected to the travelling cable pulley block, provided with a clamping or friction mechanism which engages the deepwater hoisting cable and holds it. Alternatively, the main hoisting cable can be provided with a collar or stop for interaction with the trolley such that the collar is supported by the trolley. Alternative mechanism suitable for connecting the main hoisting cable and the trolley can also be used.

In the preferred embodiment shown in FIGS. 1-7, the releasable attachment mechanism 25 is part of the trolley 18. In alternative embodiment, the releasable attachment mechanism is part of the travelling cable pulley block, or is a separate element which can be positioned to directly engage the main hoisting cable and the deep water cable.

It is observed that with a hoisting device comprising a guided trolley, the distance over which heave compensation can be provided to the main hoisting device is determined by the guide length of the guides supporting the trolley and the heave to be compensated. For example when the guides of the trolley extend over a trajectory of 50 meters, and the heave to be compensated is 2 meters, the maximum trajectory for providing heave compensation is 48 meters. Thus the main hoisting cable and the deepwater hoisting cable should only be connected when the remaining distance to the deepwater installation site is less than 48 meters.

In this text the following words below should be interpreted as indicated.

A floating vessel, can be any kind of vessel, such for example a drilling vessel, or a floating platform such as a production platform.

Deepwater relates to offshore areas where water depths exceed approximately 200 m, the approximate water depth at the edge of the continental shelf.

A deepwater installation site, is a site such as for example a template or other structure, or the seabed, at a depth of over 200 m, preferably at a depth of over 1 km preferably at a depth of over 2.5 km.

Near the water surface, may be above and/or below the water surface, preferably between a height of 100 m above the water surface, and a depth of up to 100 m below the water surface.

Hoisting cable, preferably cable made of steel wires. Preferably, the deepwater hoisting cable is a continuous steel wire cable, which preferably is connected to the trolley by a clamping mechanism, preferably a hydraulic clamp.

Free hanging section, is the part of the cable hanging down from the load bearing structure for supporting the object connecting device, such as a hook.

A clamping mechanism for example comprising a clamp activated by a hydraulic or pneumatic cylinder, or a guiding opening designed for receiving wedges to clamp the cable in the opening.

Cylinder, hydraulic or pneumatic cylinder, comprising a cylinder rod which is moveably supported in the cylinder body. The rod can be moved between a fully retracted position, in which the cylinder rod is essentially located in the cylinder body, and an extend position, in which the cylinder rod is essentially located outside the cylinder body. Furthermore, a cylinder can be moved in an intermediate position, wherein the cylinder rod is essentially halfway between the retracted and the extended position

The invention claimed is:

1. A multi purpose hoisting device for use on a floating vessel having a deck, the hoisting device comprising:

a load bearing structure to be mounted on the vessel;

a main hoisting mechanism for raising and lowering an object above the deck of the vessel, the main hoisting mechanism comprising:

i. at least one main hoisting winch;

ii. an upper cable pulley block supported by the load bearing structure; said upper cable pulley block comprising multiple pulleys;

iii. a travelling cable pulley block comprising multiple pulleys, provided with an object connecting device for releasable connecting an object to the travelling cable pulley block;

iv. a main hoisting cable associated with the at least one main hoisting winch, the main hoisting cable being passed over the pulleys of the upper cable pulley block and the pulleys of the travelling pulley block in a multiple fall configuration, such that the travelling cable pulley block is moveable relative to the load bearing structure by using the at least one main hoisting winch;

a main hoist heave compensation mechanism associated with the main hoisting cable for damping the effect of sea-state induced motion of the vessel onto an object supported by the main hoisting cable;

wherein the multi purpose hoisting device further comprises:

a deepwater hoisting mechanism for raising and lowering an object to an installation site in deepwater, the deepwater hoisting mechanism comprising:

i. a deepwater hoisting winch;

ii. a deepwater hoisting cable, the deepwater hoisting cable running along a path from the deepwater hoisting winch to a top pulley supported by the load bearing structure, wherein from the top pulley, the deep water hoisting cable is suspended for supporting a load, and the path of the deepwater hoisting cable is distinct from the main hoist heave compensation mechanism;

iii. an object connecting device for releasable connecting an object to the deepwater hoisting cable; and a releasable attachment mechanism adapted to selectively interconnect the main hoisting cable and the deepwater hoisting cable such that the heave compensation mechanism associated with the main hoisting cable is operable in combination with the deepwater hoisting cable.

2. The hoisting device according to claim 1, wherein the main hoisting mechanism comprises a trolley supporting the releasable attachment mechanism, the trolley is connected to the travelling cable pulley block of the main hoisting mechanism, and is moveably attached to the load bearing structure, such that the trolley is movable relative to the load bearing structure using the main hoisting mechanism.

3. The hoisting device according to claim 2, wherein the trolley is provided with a guiding device for guiding the deepwater hoisting cable when the latter is supporting an object, the guiding device being adapted to position the deepwater hoisting cable with respect to the releasable attachment mechanism to facilitate interconnecting the main hoisting cable and the deepwater hoisting cable.

4. The hoisting device according to claim 3, wherein the guiding device is an open-sided slotted guide opening.

5. The hoisting device according to claim 1, wherein the releasable attachment mechanism comprises a friction device to engage on the deepwater hoisting cable.

6. The hoisting device according to claim 5, wherein the friction device is a friction clamping mechanism.

7. The hoisting device according to claim 1, wherein the deepwater hoisting cable is moveably supported by the load bearing structure, for example by a hingeably jib, such that a free hanging section of the deepwater hoisting cable can be moved relative to the attachment mechanism in a horizontal direction between a first position, in which the free hanging section of the deepwater hoisting cable is positioned at a distance from the mechanism, and a second position, in which the free hanging end of the deepwater hoisting cable is positioned such that they can be interconnected.

8. The hoisting device according to claim 1, wherein the main hoisting mechanism is adapted to support an object weighing 400 metric tons or more, and wherein the deepwater hoisting mechanism is adapted to support an object weighing up to 300 metric tons.

9. The hoisting device according to claim 1, wherein the deepwater hoisting mechanism is adapted to lower an object to a depth of at least 1 km.

10. The hoisting device according to claim 9, wherein the deepwater hoisting mechanism is adapted to lower an object to a depth of 2.5 km or more.

11. The hoisting device according to claim 1, wherein the load bearing structure is a crane comprising a slewable jib supporting the multiple fall configuration of the main hoisting cable and a free hanging section of the deepwater cable, the main hoist cable and the deepwater cable extending from their winched upwards through the mast to a rotatable top cable pulley assembly and from there to respective cable pulley assemblies supported by the jib, and wherein the deepwater cable is supported by a top cable pulley assembly mounted on a trolley which is movably attached to the jib, the trolley allowing the deepwater cable to be moved towards and away from the main hoisting cable.

12. The hoisting device according to claim 1, wherein the load bearing structure is a drilling tower, or a J-lay pipe laying tower.

13. The hoisting device according to claim 1, wherein the main hoist heave compensation mechanism comprises at least one cylinder supporting a cable pulley which guides the main hoisting cable such that a force can be exerted upon the main hoisting cable.

14. The hoisting device according to claim 1, wherein the main hoist heave compensation mechanism comprises:

an electronic system adapted to detect heave and drive the one or more main hoisting winches to provide active heave compensation;

an underload protection cylinder supporting a cable pulley which guides the main hoisting cable such that a force is exertable on the main hoisting cable, the cylinder being normally positioned in extended position to protect the main hoisting mechanism against underload or slack;

and/or an overload protection cylinder which supports a cable pulley which guides the main hoisting cable such that a force is exertable on the main hoisting cable, which cylinder is normally positioned in retracted position to protect the main hoisting mechanism against overload.

15. The hoisting device according to claim 14, further comprising a control device for controlling the underload protection cylinder and/or the overload protection cylinder, the control device being adapted to switch the cylinders between a protection mode in which they protect the main hoisting mechanism against underload or overload respectively, and a heave compensation mode, in which each cylinder is positioned in intermediate position to provide passive heave compensation.

16. The hoisting device according to claim 14, wherein the one or more cylinders are provided with an external drive adapted to move the cylinder rod in the cylinder, the external drive is controlled by the electronic system to provided active heave compensation by moving the cylinder rod in the cylinder, and the external drive includes a winch driven cable loop guided by at least two pulleys.

17. The hoisting device according to claim 14, wherein the one or more cylinders are provided with an external drive adapted to move the cylinder rod in the cylinder, the external drive is controlled by the electronic system to provided active heave compensation by moving the cylinder rod in the cylinder, and the external drive includes a winch driven cable loop guided by at least two pulleys, and wherein the one or more cylinders provide about 80% of the heave compensation and the electronic system in combination with the external drive connected to the cylinders provides about 20% of the heave compensation.

18. A floating vessel comprising a multi purpose hoisting device according to claim 1.

19. A method for lowering an object from a floating vessel to a deepwater installation site, the method comprising the step of using a multi purpose hoisting device, the hoisting device comprising:

a load bearing structure;

a main hoisting mechanism for raising and lowering an object near the water surface, the main hoisting mechanism comprising:

i. at least one main hoisting winch;

ii. a main hoisting cable associated with the at least one main hoisting winch;

connecting mechanism for releasable connecting an object to the main hoisting cable;

a main hoist heave compensation mechanism associated with the main hoisting cable for damping the effect of the movement of the vessel, as a result of heave and beating of waves, onto an object supported by the main hoisting cable;

a deepwater hoisting mechanism for raising and lowering an object to a deepwater installation site, the deepwater hoisting mechanism comprising:

i. a deepwater hoisting winch;

ii. a deepwater hoisting cable, the deepwater hoisting cable running along a path from the deepwater hoisting winch to a top pulley supported by the load bearing structure, wherein from the top pulley, the deep water hoisting cable is suspended for supporting a load, and the path of the deepwater hoisting cable is distinct from the main hoist heave compensation mechanism; and iii. a connecting mechanism for releasable connecting an object to the deepwater hoisting cable;

a releasable attachment mechanism for interconnecting the main hoisting cable and the deepwater hoisting cable such that the heave compensation mechanism associated with the main hoisting cable is operable in combination with the deepwater hoisting cable, the method further comprising:

lowering an object from a position near the water surface to an intermediate underwater position near the under water installation site, using the deepwater hoisting winch and the associated deepwater hoisting cable to support the object;

interconnecting the deepwater hoisting cable and the main hoisting cable such that the path of the deepwater hoisting cable is distinct from the main hoist heave compensation mechanism;

transferring the load of the object from the deepwater hoisting winch to the main hoisting winch, and using the main hoisting winch, the associated main hoisting cable and the deepwater cable to support the object;

if the heave compensation mechanism is turned off, switch on the heave compensation mechanism;

lowering the object from the intermediate underwater position to the under water installation site using the main hoisting winch; and using the heave compensating mechanism associated with the main hoisting mechanism for damping the effect of the movement of the vessel, as a result of heave and beating of waves, onto the object supported by the deepwater hoisting cable, while lowering the object and landing the object on the deepwater installation site.

20. The method according to claim 19, further comprising:

connecting the object to the deepwater installation site, preferably when the object is positioned in the intermediate underwater position, via a connection cable associated with a winch;

when the object is supported by the main hoisting mechanism and the deepwater hoisting cable, tensioning the connecting cable using the winch and thus exerting a force on the object in a substantial vertical direction, against the force exerted by the heave compensation mechanism of the main hoisting mechanism, and pulling the object to the deepwater installation site and landing the object on the deepwater installation site using the connection cable and the associated winch.

21. The method according to claim 19, further comprising a step of using a multi purpose hoisting device on a floating vessel having a deck, the hoisting device comprising:

a load bearing structure to be mounted on the vessel;

a main hoisting mechanism for raising and lowering an object above the deck of the vessel, the main hoisting mechanism comprising:

i. at least one main hoisting winch;

ii. an upper cable pulley block supported by the load bearing structure; said upper cable pulley block comprising multiple pulleys;

iii. a travelling cable pulley block comprising multiple pulleys, provided with an object connecting device for releasable connecting an object to the travelling cable pulley block;

iv. a main hoisting cable associated with the at least one main hoisting winch, wherein the main hoisting cable is passed over the pulleys of the upper cable pulley block and the pulleys of the travelling pulley block in a multiple fall configuration, such that the travelling cable pulley block is moveable relative to the load bearing structure by using the at least one main hoisting winch;

a main hoist heave compensation mechanism associated with the main hoisting cable for damping the effect of sea-state induced motion of the vessel onto an object supported by the main hoisting cable;

wherein the multi purpose hoisting device further comprises:

a deepwater hoisting mechanism for raising and lowering an object to an installation site in deepwater, the deepwater hoisting mechanism comprising:

i. a deepwater hoisting winch;

ii. a deepwater hoisting cable, the deepwater hoisting cable running along a path from the deepwater hoisting winch to a top pulley supported by the load bearing structure, wherein from the top pulley, the deep water hoisting cable is suspended for supporting a load, and the path of the deepwater hoisting cable is distinct from the main hoist heave compensation mechanism;

iii. an object connecting device for releasable connecting an object to the deepwater hoisting cable; and a releasable attachment mechanism adapted to selectively interconnect the main hoisting cable and the deepwater hoisting cable such that the heave compensation mechanism associated with the main hoisting cable is operable in combination with the deepwater hoisting cable.

22. The method according to claim 19, further comprising the step of switching from active heave compensation to passive heave compensation when landing an object on the under water installation site.

23. A hoisting device for use on a floating vessel, the hoisting device comprising:

a load bearing structure to be mounted on the vessel;

hoisting mechanism for raising and lowering an object, comprising:

i. at least one hoisting winch;

ii. a hoisting cable associated with the at least one hoisting winch, iii. an object connecting device for releasable connecting an object to the hoisting cable;

a heave compensation mechanism associated with the hoisting cable for damping the effect of the movement of the vessel, as a result of sea-state induced vessel motion onto an object supported by the main hoisting cable;

wherein the heave compensation mechanism comprises:

an underload protection cylinder which supports a cable pulley which guides the hoisting cable such that a force is exertable on the hoisting cable, which cylinder is normally positioned in extended position to protect the hoisting mechanism against underload or slack;

and/or an overload protection cylinder which supports a cable pulley which guides the hoisting cable such that a force is exertable on the hoisting cable, which cylinder is normally positioned in retracted position to protect the hoisting mechanism against overload;

a control device for controlling the underload protection cylinder and/or the overload protection cylinder, which control device is adapted to switch each of the cylinders between a protection mode in which said cylinder protects the hoisting mechanism against underload or overload respectively, and a heave compensation mode, in which each cylinder is positioned in intermediate position to provide passive heave compensation.

24. The hoisting device according to claim 23, wherein one or more cylinders are provided with an external drive for moving the cylinder rod of the cylinder, the external drive being controlled by the electronic system to provide active heave compensation by providing a force upon the cylinder rod of the cylinder.

25. The hoisting device according to claim 24, wherein the device includes an electronic system for detecting heave and for driving the at least one hoisting winch for providing active heave compensation, and wherein the one or more cylinders provide about 80% of the heave compensation and wherein the electronic system in combination with the external drive connected to the cylinders provides about 20% of the heave compensation.

26. A floating vessel provided with a hoisting device according to claim 23.

27. A method for performing offshore drilling activities from a floating vessel, comprising the step of using the hoisting device according to claim 23 mounted on said vessel.

28. The method according to claim 27, further comprising the step of suspending a rotary top drive from the main hoisting device while performing drilling with a drill string connected to and driven by said rotary top drive.

29. The hoisting device according to claim 23, further comprising an electronic system for detecting heave and for driving the at least one hoisting winch for providing active heave compensation.

* * * * *